US006598444B2

(12) United States Patent
Focken

(10) Patent No.: US 6,598,444 B2
(45) Date of Patent: Jul. 29, 2003

(54) TANGENTIAL ROLLING HEAD

(75) Inventor: Andreas Focken, Schwarzenbek (DE)

(73) Assignee: Wilhelm Fette GmbH, Schwarzenbek (DE)

( * ) Notice: Subject to any disclaimer, the term of this patent is extended or adjusted under 35 U.S.C. 154(b) by 0 days.

(21) Appl. No.: 10/107,123

(22) Filed: Mar. 26, 2002

(65) Prior Publication Data

US 2003/0084697 A1 May 8, 2003

(30) Foreign Application Priority Data

Nov. 7, 2001 (EP) ..... 01126354

(51) Int. Cl.[7] ..... B21H 3/04
(52) U.S. Cl. ..... 72/104; 72/108
(58) Field of Search ..... 72/102, 104, 108, 72/120, 121, 407

(56) References Cited

U.S. PATENT DOCUMENTS 3,439,518 A * 4/1969 Burnett ..... 72/101
4,336,703 A * 6/1982 Thomas ..... 72/104
5,167,136 A * 12/1992 Pietrantoni et al. ..... 72/101
5,784,912 A * 7/1998 Focken et al. ..... 72/104
6,202,461 B1 * 3/2001 Brinkman ..... 72/104

OTHER PUBLICATIONS

Article from "Verstellbarer Tangential–Rollkopfhalter fur NC and CNC Drehautomaten", —see Statement of Relevancy.

* cited by examiner

*Primary Examiner*—Ed Tolan
(74) *Attorney, Agent, or Firm*—Vidas, Arrett & Steinkraus P.A.

(57) ABSTRACT

A tangential rolling head with a basic body including means for loading it in a machine tool, two two-armed levers pivotally supported about a common axis of the basic body one lever arm of which is traversed by a formed-type roll and the other lever arm of which is traversed by a spindle which has a circumferential annular groove, a sheet metal element which has a forked portion and a fastening portion wherein the forked portion engages the annular groove and the fastening portion is adapted to be fastened in a recess of the basic body by means of a pin, characterized in that the sheet metal element is rigidly formed and is supported in the recess on the two sides by means of disc springs slid onto the pin.

5 Claims, 4 Drawing Sheets

TANGENTIAL ROLLING HEAD

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

Tangential rolling heads have two molding rolls which are rotatably supported at the ends of lever arms. The lever arms are adapted to be pivoted about a common axis of a basic body in order to vary the spacing between the molding rolls. The basic body is provided with means for loading it into a machine tool with those means usually having a shank which laterally projects from the basic body. The workpiece is rotatingly driven during the machining operation and the molding rolls move transversely towards the workpiece and machining is completed when the molding rolls and the axis of the workpiece are in one plane. This end position is normally reached after 15 to 30 rotations of the workpiece.

If different threads and threads of different diameters are to be made it requires to exchange the molding rolls or to change the spacing of the molding rolls from each other by displacing the lever arms via suitable adjusting screws with each associated lever arm being associated with an adjusting screw.

The Fette company journal "Verstellbarer Tangential-Rollkopfhalter für NC-und CNC-Drehautomaten" has made known a rolling head holder in which a clamping bolt can be fastened in a recess of the basic body with the bolt, in turn, accommodating a spring steel sheet in a recess. The spring steel sheet is fixed in the clamping bolt by means of a clamping sleeve. The spring steel sheet is fork-shaped. outside the clamping bolt and interacts with a spindle traversing the lever arms. The spring steel sheet has the function of maintaining the adjusted axial position of the molding rolls and to yield if the relative orientation of the workpiece and the molding rolls is not central. Since a relative displacement occurs with respect to the holder if the levers carrying the molding rolls are pivoted the spring steel sheet is of a fork shape in order to compensate the different positions.

Now that the speeds of NC machines and rolling heads increase more and more high torques result during the start-up and stop, which causes the spring steel sheet to get under a significant load. Thus, ruptures occur again and again, which interrupts the production process.

The object of the invention is to provide a tangential rolling head in which the holder maintains its function even in case of a high load.

BRIEF SUMMARY OF THE INVENTION

The sheet metal element is of a rigid design in the invention. Thus, it is intended not to bend at all or only in a negligible manner if the annular groove effects a relative motion with respect to the sheet metal element. Rather, disc springs are located on the two sides of the sheet metal element adjacent to the recess, which makes the sheet metal element more or less pivotable as a whole if a deflection from the central position should become necessary.

The invention not only helps in keeping the rolling head in a position central to the tool if the distance of the rolling head axis is varied, but we will also obtain a spring action for the case that the tool is not central towards the rolling head. The spring load is absorbed by the disc springs which have a long service life. A relatively small change of the angle is achieved for the spring metal sheet, thus avoiding any tilt in the spindle groove.

The tangential rolling head of the invention, as known rolling heads do as well, obtains a balance in length if the distance of the axis is varied in the rolling head.

There is no fixed connection between the rolling head and the basic body. Therefore, the rolling head may be removed from the holder in a simple way, e.g. for a roller change, settings by a gauge, etc. When the rolling head is inserted the sheet metal element will engage the spindle groove without any aid.

Another specific advantage is that the inventive holder for the tangential rolling head is built very compactly. The space which is left vacant as compared to conventional rolling heads may be utilized for fastening different types.

BRIEF DESCRIPTION OF THE SEVERAL VIEWS OF THE DRAWINGS

An embodiment of the invention will now be explained in more detail with reference to the drawings.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
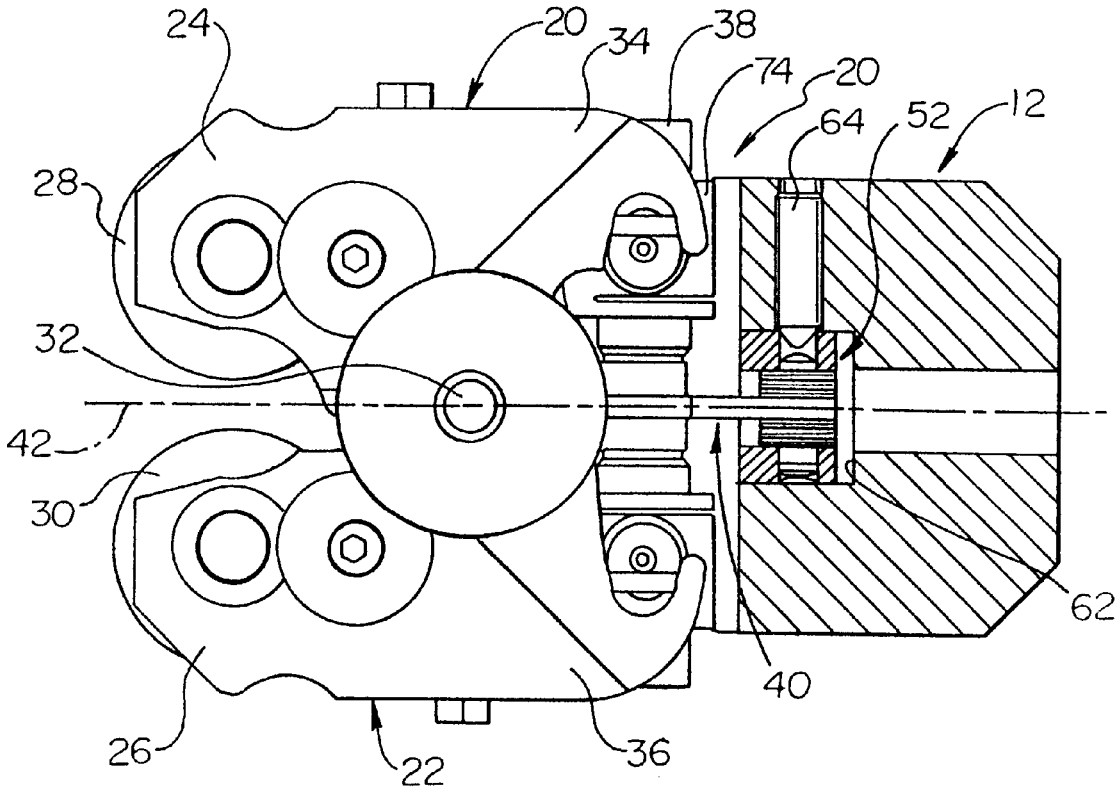
FIG. 1 shows a tangential rolling head of the invention along lines 1—1 of FIG. 2, partly in a side view, partly in a section.
Figure 2:
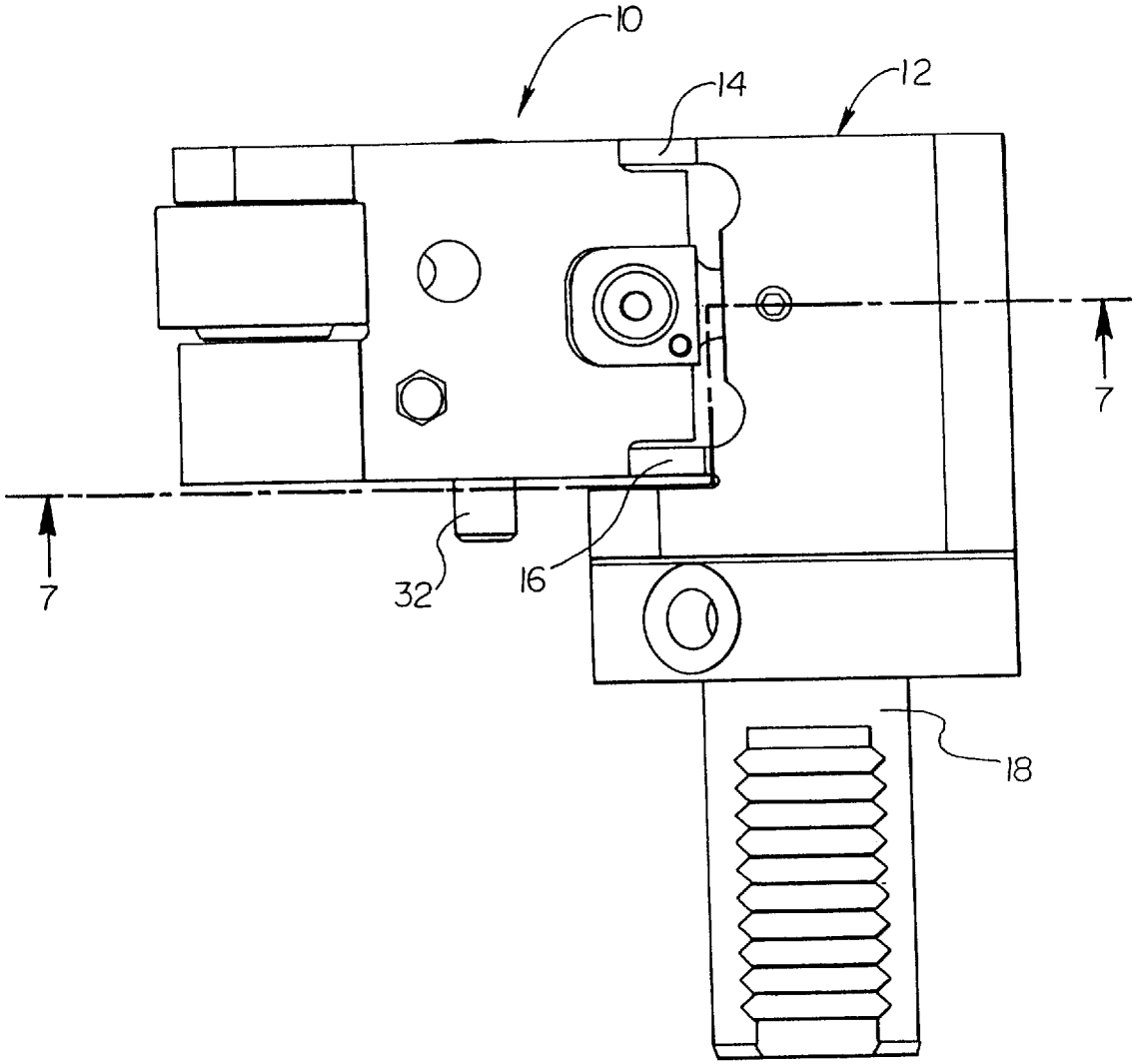
FIG. 2 shows a plan view of the tangential rolling head of FIG. 1, shows an insert piece with a sheet metal element of the tangential rolling FIG. 3 head of FIGS. 1 and 2.
Figure 3:
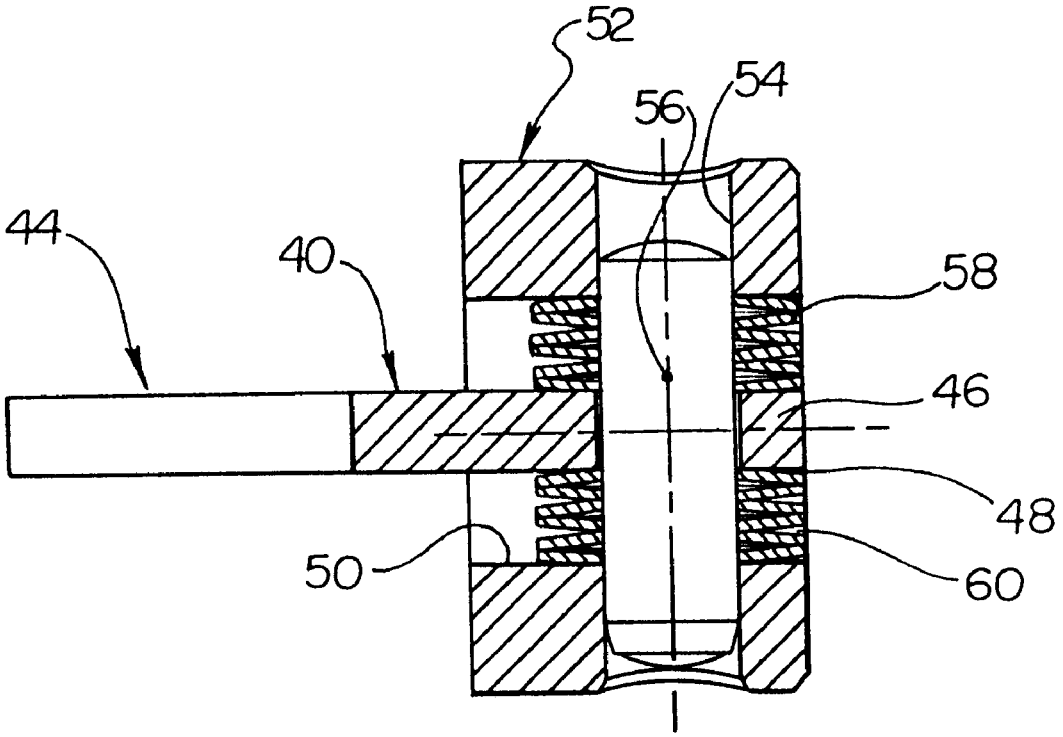

The rolling head 10 illustrated in FIGS. 1 and 2 has a basic body 12 which is provided with two forked arms 14, 16 as well as a shank 18 projecting transversely therefrom, which is loaded into a machine tool which is not shown. The rolling head 10 further has two levers 20, 22 the front lever arm 24, 26 of which supports a molding roll 28 and 30 which are at a predetermined spacing from each other. The levers 20, 22 are pivotally supported about a gudgeon 32 which extends through the two forked arms 14, 16. To such an extent, the tangential rolling head described is the state of the art. No detailed reference will be made to how to actuate the molding rolls 28, 30 during the forming process.

The rear lever arms 34, 36 are traversed by a spindle 38. The lever arms 34, 36 have threaded bores (not shown) which mate with threaded portions of the spindle 38 (not shown either) with the threaded portions being in an opposite sense so that if the spindle is rotated the molding rolls 28, 30 are either moved towards each other or away from each other depending on the sense of rotation of the spindle 38.

The spindle has an annular groove (not shown either) which is approximately central and interacts with a fork-like portion of a sheet metal element 40 which will be described farther below. The annular groove is at the level of the axis 42 which represents the middle between the molding rolls 28, 30. If this spacing is varied it is important that each roll 28, 30 be displaced by the same amount each to avoid varying the central position of the molding rolls 28, 30 because this would otherwise cause the axes to be shifted with respect to the workpiece.

Figure 4:
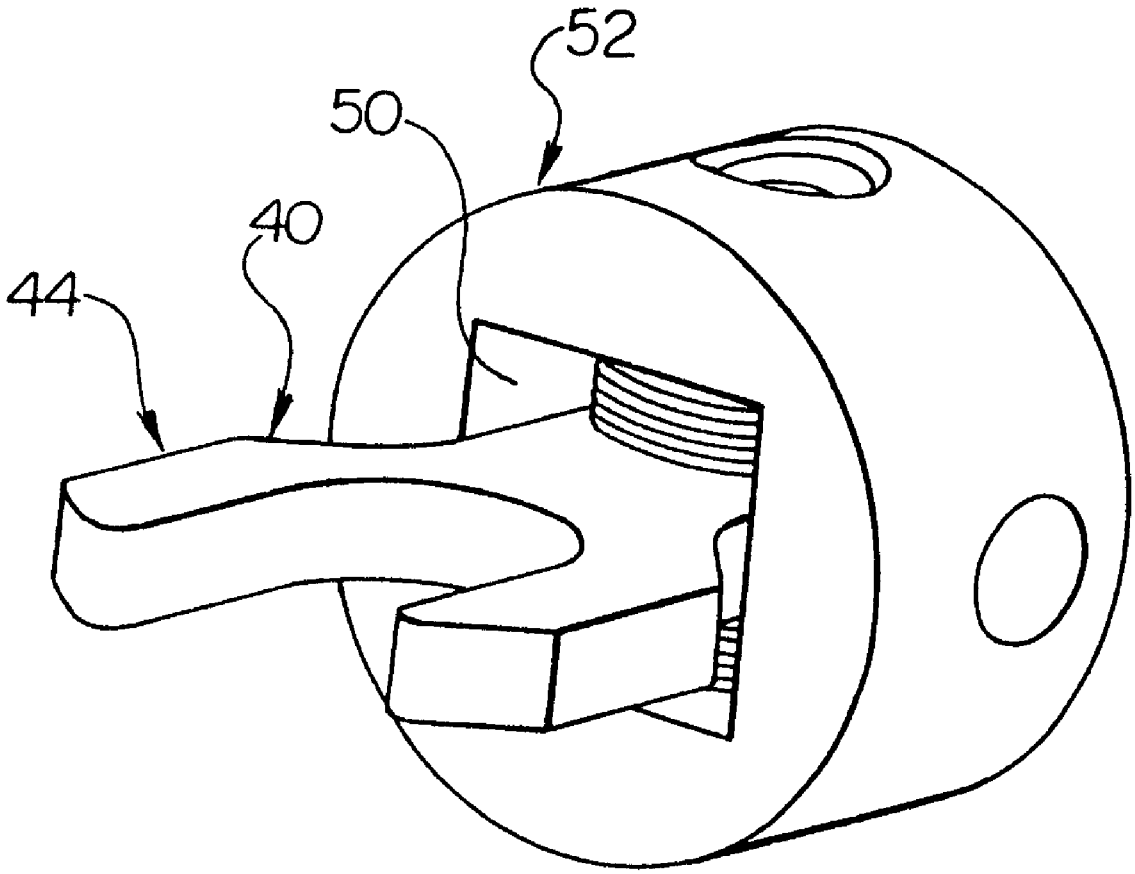
FIG. 4 shows the assembly of FIG. 3 in a perspective representation.

The forked portion of the sheet metal element 40 can be seen from FIG. 4. It is designed so as to fittingly engage the annular groove (not shown) of the spindle 38 as was mentioned already. The sheet metal element 40, which is designed to be relatively thick and, thus, to be very rigid, has a fastening portion 46 which has a through bore 48. The fastening portion 46 is seated in a recess 50 of an insert piece 52. The insert piece 52 is cylindrical as can be seen from FIG. 4 and has a diametrically extending through bore 54 into which a pin 56 is fitted. The pin 56 extends through the bore 58 of the fastening part of portion 46. Either side of the sheet metal element 40 has arranged thereon disc spring packs 58, 60 via which the sheet metal element 40 is supported on the upper and lower sides of the recess 40. As is apparent from FIG. 1 the insert piece 52 is received in an appropriate recess 62 of the basic body 12 and is located there by means of a stud 64.

If there is an eccentricity between the workpiece and the molding rolls 28, 30 the lever arms 20, 22 will be jointly pivoted to a slight degree, which causes the annular groove to move axially, thus pivoting the sheet metal element 40. However, this swing is minimal so that no jamming will occur in the annular groove. The abrupt loads acting during the start-up and stop of the machine tool may be absorbed by the disc spring packs 58, 60 in a simple way.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A tangential rolling head with a basic body including means for loading it into a machine tool, two two-armed levers pivotally supported about a common axis of the basic body one lever arm of which is traversed by a former roll and the other lever arm of which is traversed by a spindle which has a circumferential annular groove, a sheet metal element which has a forked portion and a fastening portion wherein the forked portion engages the annular groove and the fastening portion is adapted to be fastened in a recess of the basic body by means of a pin, characterized in that the sheet metal element (40) is rigidly formed and is supported in the recess (50) on the two sides by means of disc springs (58, 60) slid onto the pin (56).

2. The tangential rolling head according to claim 1, characterized in that the recess (50) is formed in a separate insert piece (52) which is adapted to be fastened in a further recess (62) of the basic body (12).

3. The tangential rolling head according to claim 2, characterized in that the insert piece (52) is adapted to be fastened in the further recess (62) by means of a pin (64).

4. The tangential rolling head according to claim 3, characterized in that the insert piece (52) is of a cylindrical shape and that the further recess (62) is of a complementary shape.

5. The tangential rolling head according to claim 1, characterized in that the spindle (38) has opposite-sense threaded portions which engage threaded bore portions of the other lever arms (34, 36) for a self-adjustment of the molding rolls (28, 30) from each other upon rotation of the spindle (38).

* * * * *